United States Patent [19]

Higgins

[11] 4,265,195

[45] May 5, 1981

[54] MARKERS FOR ELECTRIC FENCES

[76] Inventor: Wayne G. Higgins, Valley High On Lost River Rd., North Woodstock, N.H. 03262

[21] Appl. No.: 77,397

[22] Filed: Sep. 20, 1979

Related U.S. Application Data

[63] Continuation-in-part of Ser. No. 969,465, Feb. 1, 1979, abandoned.

[51] Int. Cl.[3] ..... A01K 3/00; E04H 17/00

[52] U.S. Cl. ..... 116/209; 256/4; 256/10

[58] Field of Search ..... 116/209; 256/4, 10

[56] References Cited

U.S. PATENT DOCUMENTS

| | | | |
|---|---|---|---|
| 8,757 | 6/1879 | Wilson et al. | 256/4 |
| 249,777 | 11/1881 | La Fleur | 256/4 |
| 294,572 | 3/1884 | Boone, Jr. | 256/4 |
| 321,787 | 7/1885 | Boone, Jr. | 256/4 |
| 367,664 | 8/1887 | Riale | 256/4 |
| 367,893 | 8/1887 | Cloud | 256/4 |
| 2,622,553 | 12/1952 | Wilson | 256/10 X |
| 2,753,833 | 7/1956 | Tiasley | 116/200 |
| 3,304,038 | 2/1967 | Guthrie | 256/10 |
| 3,785,337 | 1/1974 | Flowerday | 256/4 X |
| 4,050,404 | 9/1977 | McMackin | 116/209 |

*Primary Examiner*—Daniel M. Yasich
*Attorney, Agent, or Firm*—Glenn H. Antrim

[57] ABSTRACT

A marker for an electric fence to warn persons of a long span of bare wire is preferably fabricated from insulating plastic that is stiffly elastic. A groove across a face of a piece of the plastic is somewhat deeper than the diameter of the wire to which the marker is to be attached and is somewhat more narrow so that the wire can be pressed firmly into the groove. The piece of plastic is therefore prevented from sliding along the wire by being gripped within the groove. A streamer is threaded over the plastic piece such that it cannot readily contact the wire.

2 Claims, 3 Drawing Figures

MARKERS FOR ELECTRIC FENCES

This is a continuation-in-part of Application Ser. No. 969,465, filed Feb. 1, 1979, now abandoned.

BACKGROUND OF THE INVENTION

Before electric fences were available, different types of markers were applied to strands of barbed wire near traveled routes to warn persons of the danger of being cut by barbs. Commonly, the markers were streamers of cloth tied between parallel strands of the fences. Others were blocks of wood or plates of other materials tied to single strands. Another type suitable not only for fences having parallel strands of barbed wire but also suitable for electric fences that have long spans of single strands of smooth wire comprises metal markers with tabs to be bent tightly over the wire. However, most commonly single strands of electric fences are marked by merely tying streamers of cloth to them. The tied streamers are not very suitable because wind can move the streamer until each of the streamers encounters a post. Also, streamers of cloth or similar material retain moisture to make them conductive, and the streamers while conductive can short-circuit the electric fence or cause a painful shock to a person whom they might contact.

SUMMARY OF THE INVENTION

Markers according to the present invention are blocks or plates of insulating material to which streamers are attached. The plates are fabricated from stiff, electrically insulating material and have respective grooves into which wire is tightly pressed. The width of the grooves is somewhat less and the depth is somewhat greater than the diameter of the wire to be used with the fences. A suitable material for the plates is low-density polyethylene that has sufficient elasticity to grip the wires tightly for preventing the blocks from traveling along the wires to which they are attached.

A groove is preferably across the face near one end of each of the blocks or plates for dividing each plate into an upper portion that is smaller than a respective lower portion. The lower portion contains a hole from which hangs a streamer. The streamer for each plate has one end attached about midway to the face of the upper portion above the groove and extends over the top of the plate, down the face opposite the face having the groove where it cannot come in contact with the wire, and through the hole to hang from the lower portion. A preferred embodiment has a boss across the face of the plate and the groove is in the boss.

DESCRIPTION OF THE PREFERRED EMBODIMENTS

Figure 1:
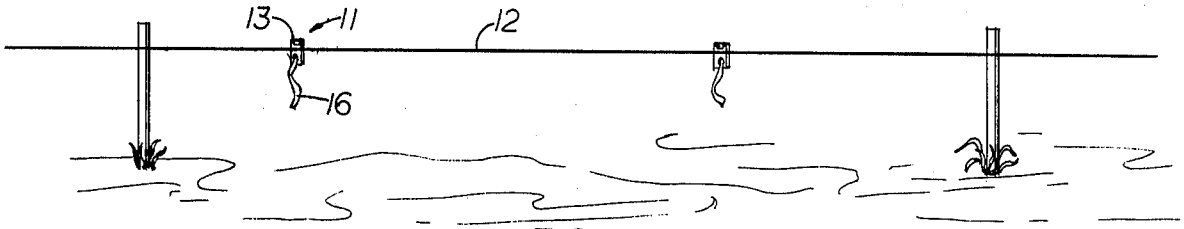
FIG. 1 is a fragmentary view of an electric fence to which markers are applied.
Figure 2:
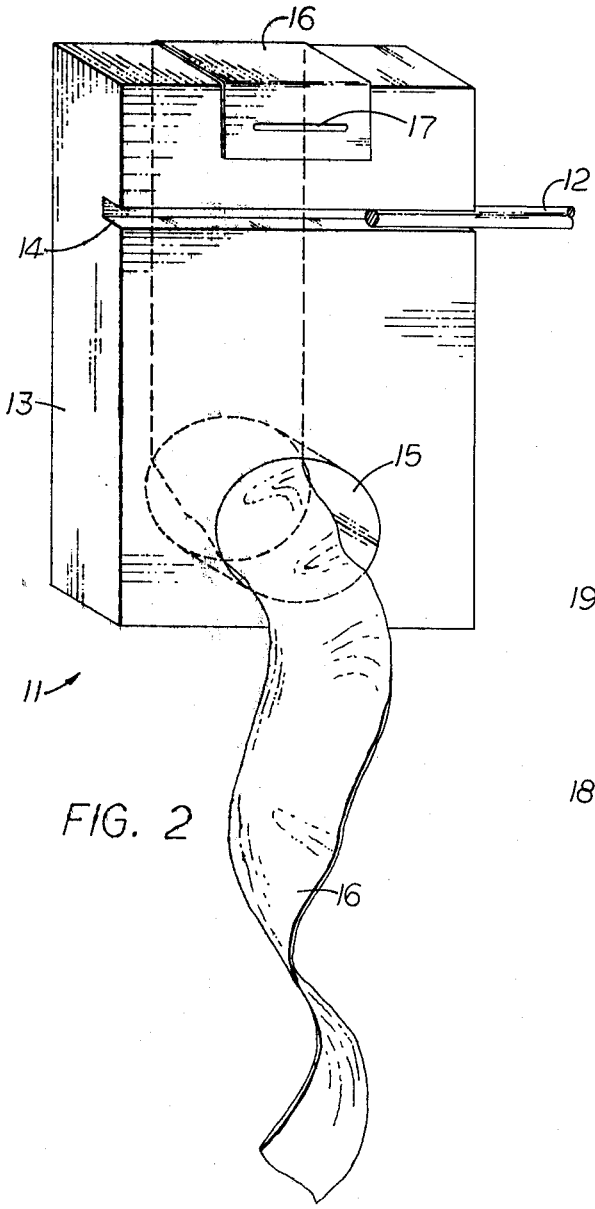
FIG. 2 is a front perspective view of a marker according to this invention.

In FIG. 1, a wire 12 of an electric fence has attached to it a marker 11 comprising a rectangular plate 13 and a streamer 16. The plate 13 as shown in detail in FIG. 2 is a rectangular piece of insulating material that is stiff but elastic. Hardwood has the required characteristics except that it tends to become conductive when it is wet. A more suitable material is low-density polyethylene to be formed by injection molding ready for attachment of the streamer 16.

The marker 11 is attached to the wire 12 by aligning a groove 14 of the plate 13 with the wire and pressing the wire into the groove. The groove 14 is across the upper portion of a face of plate 13, and different plates 13 for different sizes of wire 12 will have different suitable widths of grooves 14. The width of the groove 14 is slightly less than the diameter of the wire 12 such that the wire can be pressed tightly into the groove with moderate force, and the depth of the groove 14 is 2 or 3 millimeters greater than the diameter, of the wire 12. The larger portion of the plate 13 that is the portion below the groove 14 has midway between its sides a hole 15. The diameter of the hole is such that the streamer 16 can be readily passed through it, for example, a hole having a diameter of approximately 20 millimeters to accommodate the streamer of about that width. The upper end of the streamer 16 is attached with a stable 17 at a position midway between the sides of the plate 13 above the groove 14, and the streamer extends away from the groove 14, up over the top of plate 13 and down the back face of the plate 13 through the hole 15 to hang from the front face of the plate 13.

Figure 3:
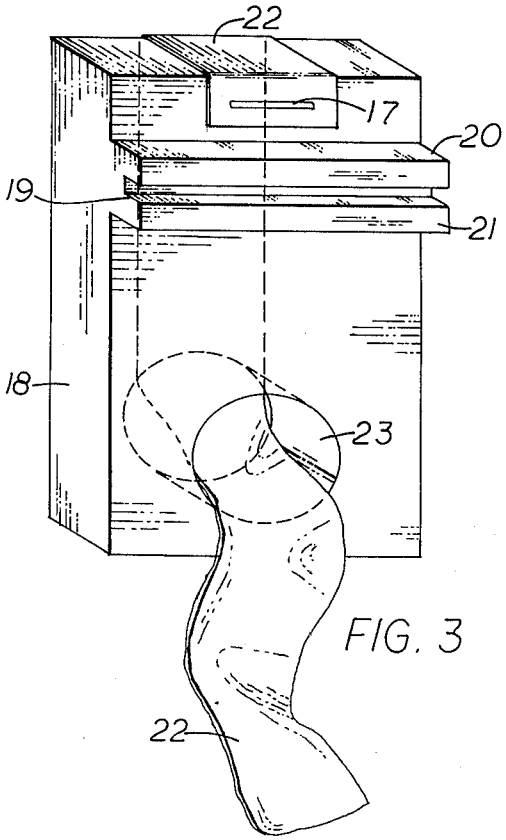
FIG. 3 is a front perspective view of another embodiment of the marker.

A different embodiment requiring less material for a plate and having greater flexibility for gripping the wire 12 is shown in FIG. 3. The plate 18 of FIG. 3 corresponding to the plate 13 of FIG. 2 may generally be thinner, and a groove 19 corresponding to the groove 14 rather than being below the face of the plate is contained between two parallel raised strips 20 and 21 that extend across the upper portion of one of the faces of the plate 18. The strips 20 and 21 together might be referred to as a boss with the groove 19 through the center of the boss. According to the strength of the material that is used to fabricate the plate 18, the strips 20 and 21 have a required width with respect to the width of the groove 19 and the diameter of the wire 12 to which the plate 18 is to be attached for providing desired tension and ease of attaching the plate 18 to the wire 12. The streamer 22 is guided over the top of the plate 18 and through a hole 23 as described for FIG. 2 such that the streamer is kept from contacting the wire to which the plate 18 is attached. The method of attaching this streamer 16 and 22 is neat and protects the streamer from being torn from its fastening by wind. The plastic plates 13 and 18 to which the streamers 16 and 22 respectively are attached function as good insulators.

I claim:

1. A fence marker comprising:

a plate of stiff elastic insulating material having front and back faces, said front face having thereacross a groove with substantial length and substantially parallel sides, said groove having a depth at least somewhat greater than the diameter of wire to which said marker is to be attached and a width somewhat less than said diameter, said groove being of such width to cause said parallel sides to grip said wire tightly when said wire is pressed into said groove, said groove being located at a substantial distance from a center line across said front face such that a larger portion of said plate tends to hang below said wire and a smaller portion of said plate is held above said wire, a streamer attached to said smaller portion and extending downwardly over a portion of said back face opposite said groove to prevent contact between said streamer and said wire, said lower larger portion having an aperture through said faces thereof, and said streamer extending through said aperture to hang from said front face of said larger portion.

2. A fence marker comprising:

a plate of generally moderate thickness of stiff elastic insulating material having front and back faces, at least two adjacent raised strips of substantial length disposed transversely on said front face a shorter distance from an upper end of said plate than from an opposite lower end thereof, said raised strips having adjacent edges substantially parallel and spaced apart a distance slightly less than the diameter of a wire to form a groove therebetween into which said wire is to be tightly pressed, a streamer attached to said plate at a position above said strips and extending downwardly over a portion of said back face, a portion of said plate below said strips having an aperture through said faces thereof, and said streamer extending through said aperture to hang from said front face of said lower end of said plate.

* * * * *